United States Patent [19]

Kakehashi

[11] 3,991,646

[45] Nov. 16, 1976

[54] ARPEGGIO CIRCUIT FOR AN ELECTRONIC MUSICAL INSTRUMENT

[75] Inventor: Ikutaro Kakehashi, Osaka, Japan

[73] Assignee: Roland Corporation, Osaka, Japan

[22] Filed: Sept. 9, 1975

[21] Appl. No.: 611,607

[30] Foreign Application Priority Data

Sept. 30, 1974 Japan ..... 49-113196

[52] U.S. Cl. ..... 84/1.24; 84/1.01; 84/1.17

[51] Int. Cl.[2] ..... G10H 1/02; G10H 1/06

[58] Field of Search ..... 84/1.24, 1.01, 1.17

[56] References Cited

UNITED STATES PATENTS

| | | | |
|---|---|---|---|
| 3,639,853 | 2/1972 | Sakai | 84/1.01 |
| 3,694,559 | 9/1972 | Suzuki | 84/1.24 |
| 3,725,562 | 4/1973 | Munch et al. | 84/1.24 |
| 3,776,087 | 12/1973 | Ogi | 84/1.24 |
| 3,854,366 | 12/1974 | Deutsch | 84/1.24 |

*Primary Examiner*—E. S. Jackmon

*Attorney, Agent, or Firm*—Wenderoth, Lind & Ponack

[57] ABSTRACT

An arpeggio circuit for an electronic keyboard instrument has means for generating a desired sweep voltage which is continuously varied, a voltage control type oscillator connected to the generator for generating a sweep frequency which is varying in proportion to the sweep voltage, a plurality of pulse generating means, one for each note of the keyboard instrument, and each having a series connected resonance circuit means and pulse forming means for forming a pulse in response to the output from said resonance circuit means. The pulse generating means are connected to the oscillator in parallel with each other. Tone generator means is coupled to the outputs of the respective pulse generating means for generating tone signals in response to the outputs of the pulse generating means, and arpeggio producing means is coupled to the pulse generating means for cancelling the output of the resonance circuit means for all of the pulse generating means other than the pulse generating means corresponding to the notes of the arpeggio.

10 Claims, 4 Drawing Figures

OUTPUT TERMINALS OF FILTER
δ
LOWER KEYBOARD
α
S2
E
-B

ARPEGGIO CIRCUIT FOR AN ELECTRONIC MUSICAL INSTRUMENT

This invention relates to an arpeggio circuit for an electronic keyboard instrument, which circuit is considerably less complex than prior art circuits.

Heretofore various methods of playing an arpeggio on an electronic keyboard instrument, by means other than the usual keyboard, have been contemplated. In one arrangement, on a two-stage keyboard of an organ, i.e., an upper stage and a lower stage, for example, an arpeggio of a chord on a particular note, the key corresponding to which is actuated, is played by sequentially closing key switches $\beta$ for arpeggio on the upper stage while pushing a key from among keys and for the chord on the lower keyboard stage, as shown schematically in FIG. 1.

In the example shown in FIG. 1, a group of switches (e.g. keyswitches, one for each note) for an arpeggio is arranged such that one terminal of each switch is connected to the gate $\gamma$ for the respective tones corresponding to the notes, and the other terminal is connected with the other switches for notes in an octave relationship therewith. Groups of keyswitches for a given note are connected with the one terminal $\tau$ of each switch for the same note on the lower keyboard stage and the other terminal of these switches being grounded. When the arpeggio switches $\beta$ are closed sequentially one by one, only the gates $\gamma$ for the notes corresponding to a closed switch $\alpha$ will be opened to produce a sound, because current will flow only through the closed key switch $\alpha$ on the lower keyboard to the keyswitches $\beta$ for the corresponding notes. Accordingly, if, with keys on the lower keyboard for chords G, C and E, for example, actuated, the arpeggio switches $\beta$ are swept sequentially, all of the notes G, C and E (i.e. $G_1$, $C_1$, $E_1$, $G_2$, $C_2$, $E_2$, $G_3$, $C_3$, $E_3$) corresponding to the arpeggio switches which have been swept so as to be closed are sounded to cause an arpeggio to be played. In this case, any key for G, C and E on the lower keyboard may be pushed to produce the same effect.

In the system as described above, wherein groups of switches corresponding in number to all the keys are necessary for upper and lower keyboards, difficulties due to the use of a large number of mechanical contacts can not be avoided.

It is an object of the present invention to provide a well-functioning arpeggio circuit by which the difficulties described above are eliminated.

The invention will now be explained in detail with reference to the accompanying drawings, in which.

Figure 1:
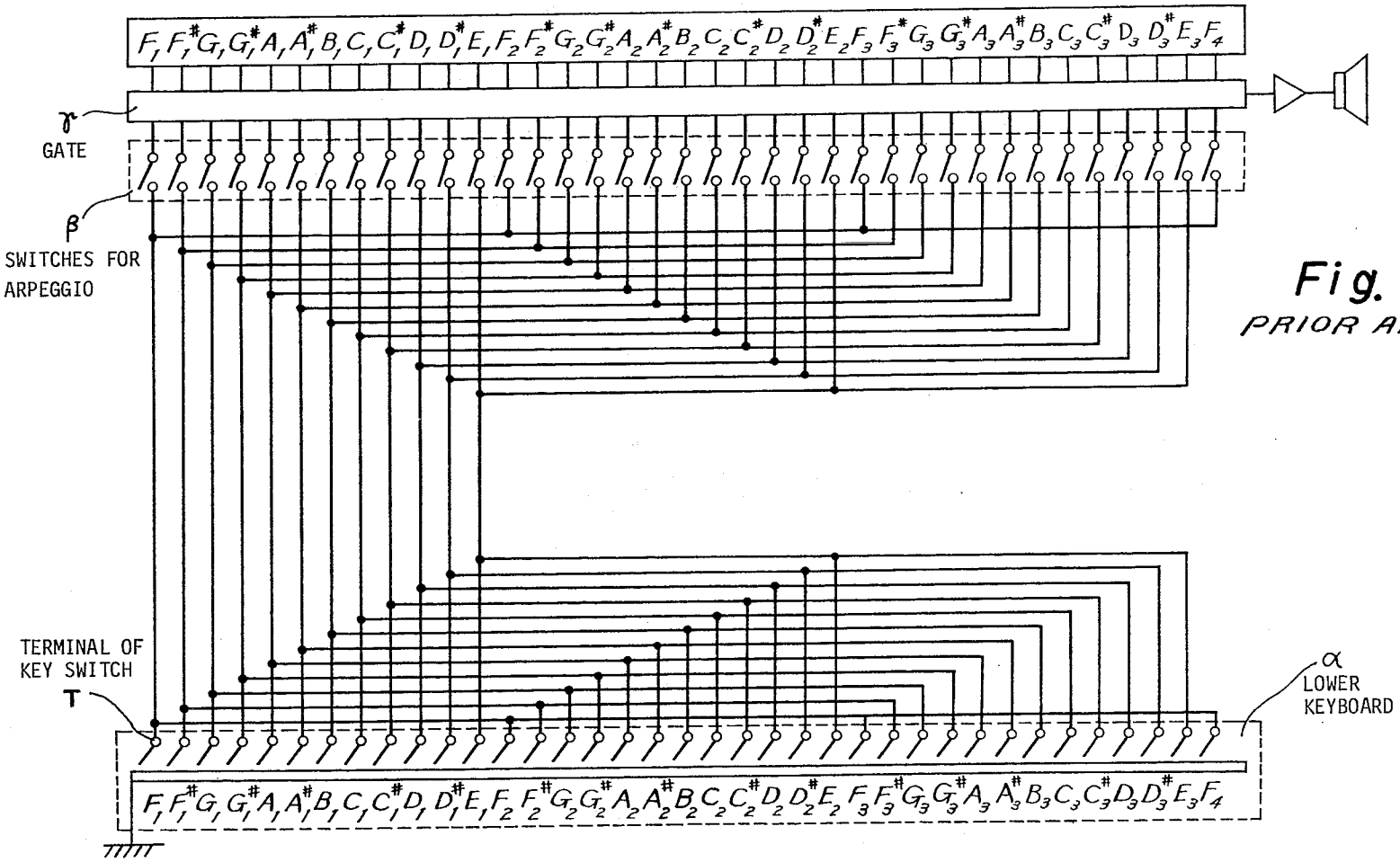
Fig. 1 PRIOR ART
FIG. 1 is a schematic diagram of a prior art arpeggio circuit.
Figure 2:
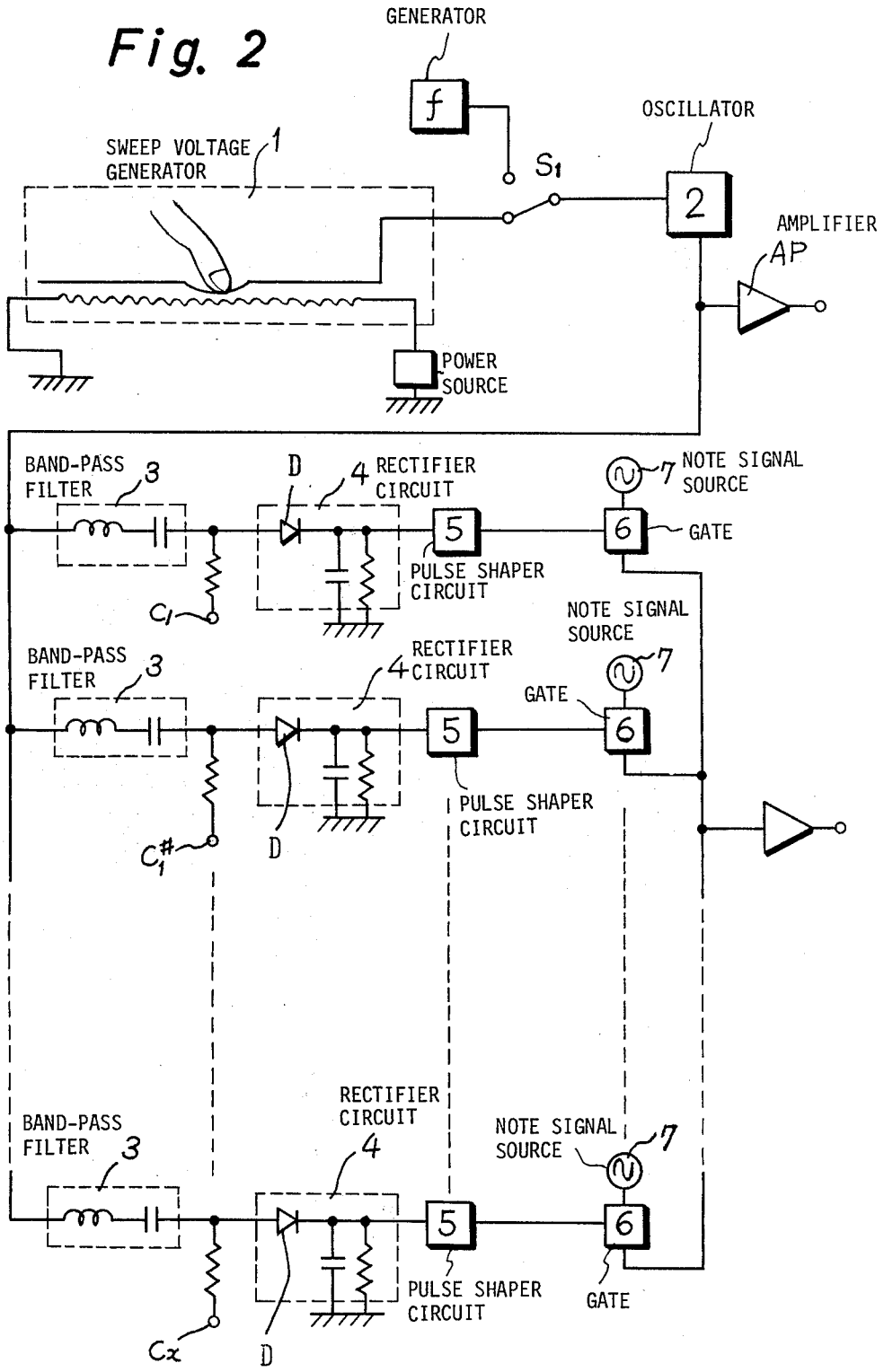
FIG. 2 is a circuit diagram of one embodiment of an arpeggio circuit according to this invention.

As shown in FIG. 2, the arpeggio comprises a sweep voltage generator having a resistance and a contact which is operated by sliding a finger therealong while pressing thereon. An output voltage proportional to the finger position along the generator is conducted through a switch S1 to a voltage-control type oscillator 2, which will deliver a signal having frequency proportional to the output voltage of said sweep voltage generator 1. When the sweep voltage generator 1 is not pressed by a finger, it will produce no voltage, and the voltage-control type oscillator 2 will produce no output. The output side of said voltage-control type oscillator 2 is connected to a group of band-pass filters 3 (hereinafter simply filters) which are connected in parallel and each consisting of an inductance L and a capacitance C, the resonance frequency of the filters corresponding to the tone signals for the respective notes of the scale. If a finger is moved along the sweep voltage generator 1 from one end thereof to the other, the oscillation frequency of the voltage-control type oscillator 2 will be varied corresponding to the sliding motion to produce a portamento. At the same time, the oscillation frequency will also sweep the filters 3 to produce a resonance effect on successive filters 3 so that a resonance voltage corresponding to each tone signal will be produced from the respective filters 3. The resonance voltage is rectified in a rectifier circuit 4 connected to each filter 3 and consisting of a diode D and a C-R circuit, and then is clipped by a pulse shaper circuit 5 connected to each rectifier circuit 4, and the thus shaped pulse is supplied to a gate 6 which gates the signal corresponding to the desired note signal source 7.

Figure 3:
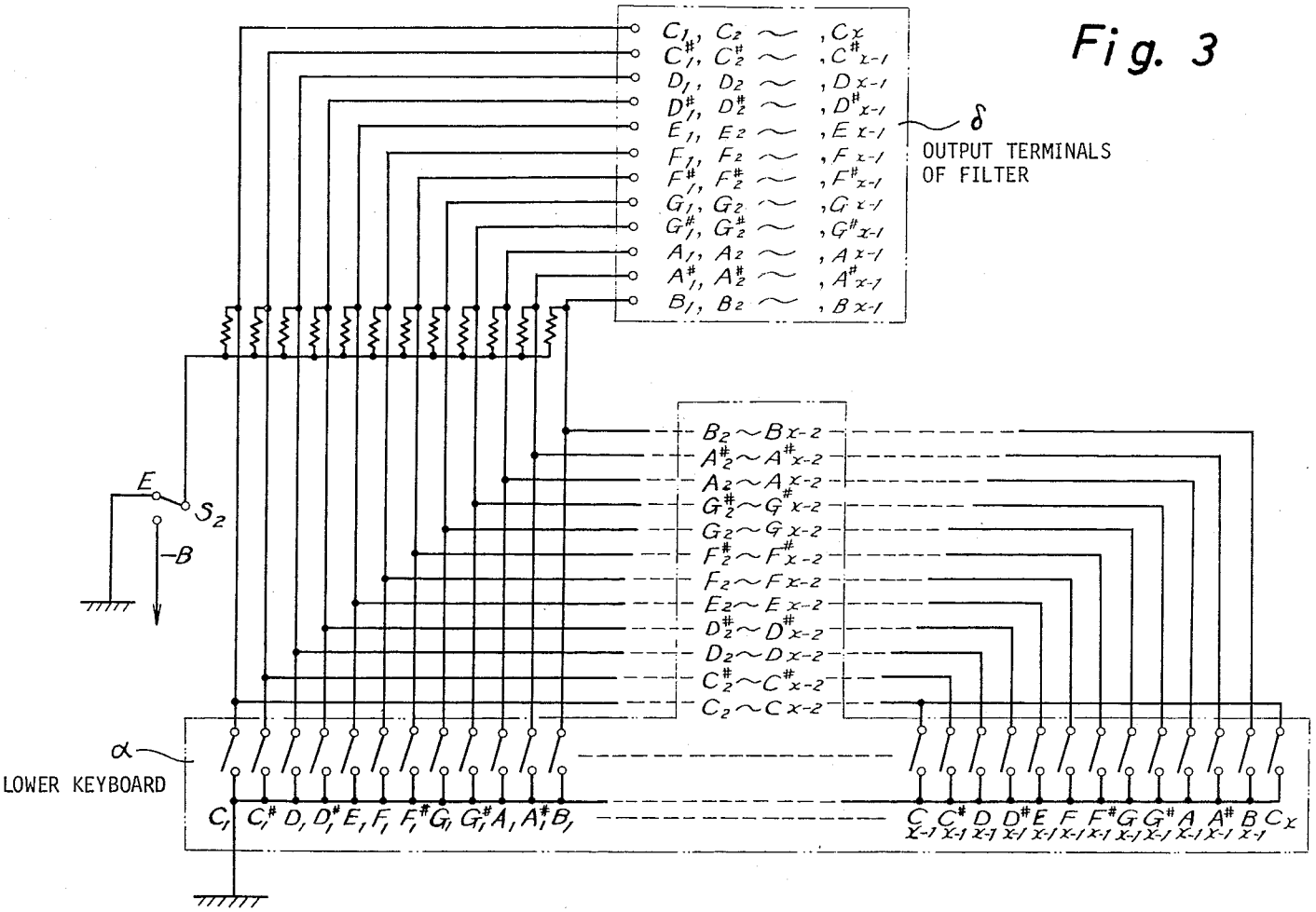
FIG. 3 is a circuit diagram of a bias circuit utilized in this invention.

In the circuit as described above, sliding a finger along said sweep voltage oscillator 1 would only produce a glissando. No arpeggio could be played. To make it possible to play an arpeggio, a bias circuit is connected to the output terminal ($C_1$. $C\#_1$, $D_1$, $D\#_1$,...$C_x$) of each filter 3 in a manner shown in FIG. 3, in order that the resonance voltage necessary for arpeggiation can be produced. In the bias circuit of FIG. 3, the keyswitches $\alpha$ of the lower keyboard (for notes in octave relationship) are connected in parallel and respectively connected to the output sides of the corresponding filters 3. A changeover switch S2 is connected in parallel to the respective filters 3 through resistances 9. One terminal E of changeover switch S2 is connected to ground and the other to a bias source −B. The operation of the bias circuit is as follows: if the changeover switch S2 is switched to terminal E, the output terminal of each filter 3 is grounded, all the diodes D will receive respective resonance voltages from the filters 3 so that only a positive half-wave thereof will pass therethrough, and a glissando will be produced. However, if the changeover switch S2 is switched to the terminal for bias voltage −B, assuming that voltage −B has a magnitude sufficient to act as a bias voltage completely eliminating the input signal applied to diode D, i.e., the resonance voltage of the filter 3, then the output terminal of the filters 3 connected to the keyswitch or keyswitches of the lower keyboard which have been actuated will be grounded, thereby eliminating the bias effect of voltage −B, so that only the diode D corresponding to the notes for the actuated keyswitches will pass the positive half-wave of the resonance voltage therethrough, thereby to generate a pulse through the pulse shaper circuit 5. The signals from the remaining filters 3 will be eliminated by the bias voltage −B, since terminals for filters 3 and the terminals of key switches $\alpha$ of the lower keyboard for notes in octave relationship are connected together, respectively. If the sweep voltage generator 1 is actuated while the keyswitches for the chord C, E, G are actuated by keys on the lower keyboard, then only the resonance voltage from the filters 3 corresponding to notes C, E, G will be passed through the diodes D in the rectifier circuits 4 for the corresponding notes and the pulse shaper circuits 5. Since the filters 3 are swept from the lowest octave to the highest, an arpeggio is produced for the chord.

The output signal from the voltage-control type oscillator 2 can be conducted to a separate amplifier AP, before it is supplied to the filters 3, to be utilized as a portamento.

Figure 4:
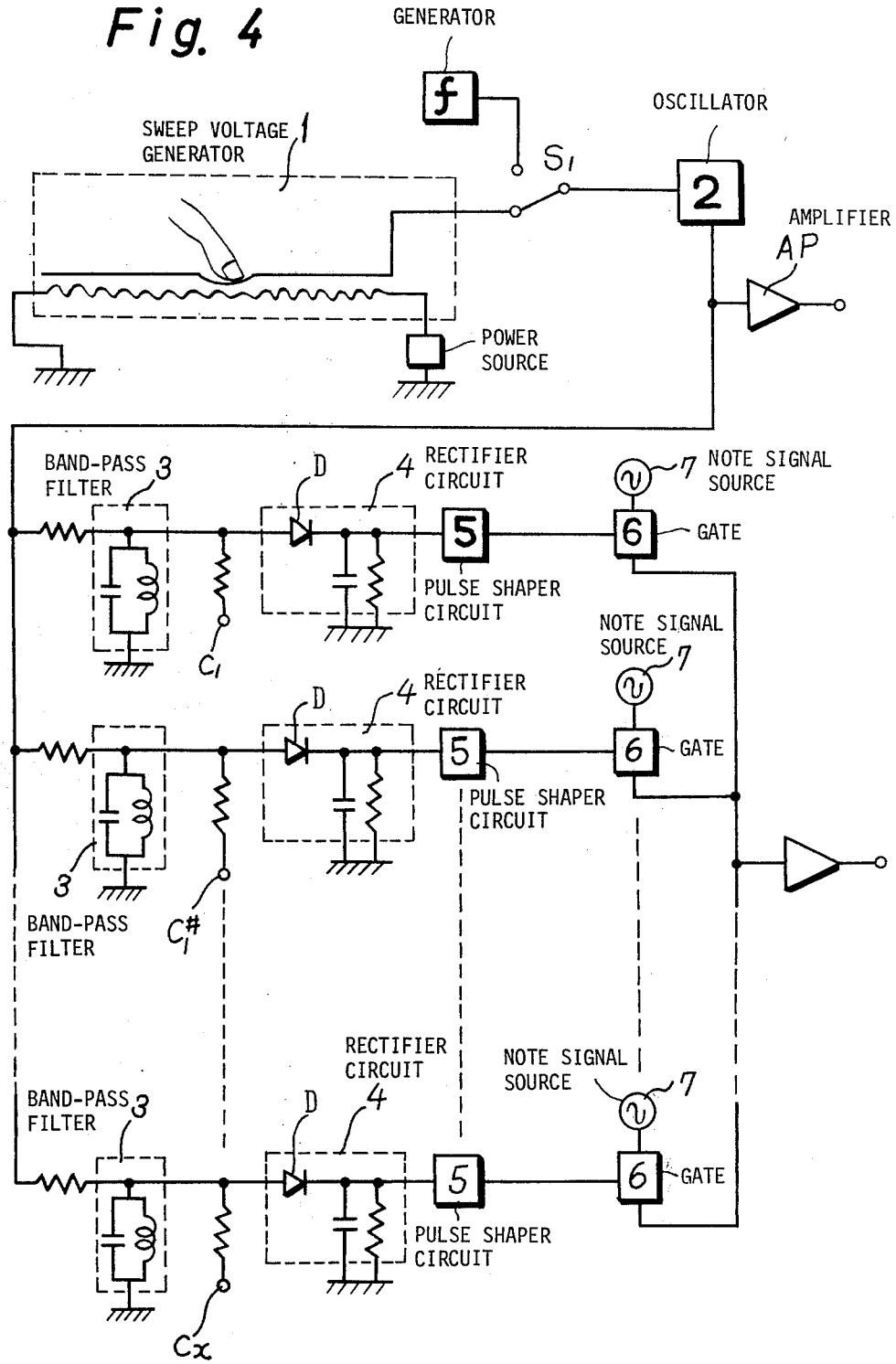
FIG. 4 is a circuit diagram of a second embodiment of an arpeggio circuit according to this invention.

In the embodiment of FIG. 2 filters are made from an inductance L and a capacitance C connected in series, but a similar effect may be obtained by a resonance circuit in which the elements are connected in parallel as shown in FIG. 4. Further, by switching over at the changeover switch S1, the sweep voltage generator 1 can be replaced by a generator f for generating any optional function wave to control the voltage-control type oscillator 2, whereby a particular mode of performance, such as an automatic arpeggio playing, can be achieved.

By making the range of sweep frequencies and the resonance frequencies of the filters 3 the same as that of the corresponding notes, a portamento can be produced by the same circuit as that for the arpeggio by switching the changeover switch S2. However, if only an arpeggio is desired, a higher resonance frequency can be used for the filter 3. This will be advantageous in that a smaller size inductance L can be used, and the manufacture and adjustment thereof will be much simpler because the resonance frequency need not be in accord with the tone source frequency.

It will be seen that the circuit of this invention is much better than those of prior art in that three kinds of performances, arpeggio, glissando and portamento, can be obtained from the same circuit including a voltage-control type oscillator and employing a far lower number of mechanical contacts.

What is claimed is:

1. An arpeggio circuit for an electronic keyboard instrument comprising means for generating a desired sweep voltage which is continuously varied, a voltage control type oscillator connected to said generator for generating a sweep frequency which is varying in proportion to the sweep voltage, a plurality of pulse generating means, one for each note of the keyboard instrument, and each having a series connected resonance circuit means and pulse forming means for forming a pulse in response to the output from said resonance circuit means, said pulse generating means being connected to said oscillator in parallel with each other, tone generator means coupled to the outputs of the respective pulse generating means for generating tone signals in response to the outputs of the pulse generating means, and arpeggio producing means coupled to said pulse generating means for cancelling the output of said resonance circuit means for all of the pulse generating means other than the pulse generating means corresponding to the notes of the arpeggio.

2. An arpeggio circuit as claimed in claim 1 in which said means for generating a sweep voltage comprises a manually actuated variable voltage generator and a function wave generator and a changeover switch coupled between said generators and said voltage control type oscillator.

3. An arpeggio circuit as claimed in claim 2 in which said manually actuated variable voltage generator comprises a resistance and a contact extending therealong and operated so as to contact the resistance by sliding a finger therealong.

4. An arpeggio circuit as claimed in claim 1 in which the range of frequencies of said oscillator and the resonant frequencies of said resonance circuit means correspond to the notes to which the resonance circuit means correspond, and said arpeggio producing means comprises means for making said arpeggio producing means ineffective for cancelling the output of said resonance circuit means, and an amplifier means connected to the output of said oscillator, whereby said circuit can produce a portamento from said amplifier, and can produce a glissando when said means for making said arpeggio producing means ineffective is operated.

5. An arpeggio circuit as claimed in claim 1 in which the range of frequencies of said oscillator and the resonant frequencies of said resonance circuit means correspond to the notes to which the resonance circuit means correspond, and an amplifier means connected to the output of said oscillator, whereby said circuit can produce a portamento from said amplifier.

6. An arpeggio circuit as claimed in claim 1 in which said arpeggio producing means comprises means for making said arpeggio producing means ineffective for cancelling the output of said resonance circuit means, whereby said circuit can produce a glissando when said means for making said arpeggio producing means ineffective is operated.

7. An arpeggio circuit as claimed in claim 1 in which said resonance circuit means comprises an inductance and a capacitance connected in series.

8. An arpeggio circuit as claimed in claim 1 in which said resonance circuit means comprises an inductance and a capacitance connected in parallel.

9. An arpeggio circuit as claimed in claim 1 in which said arpeggio producing means comprises a plurality of keyswitches corresponding to the notes of said instrument having one side grounded, the keyswitches corresponding to notes in octave relationship being connected in groups, the groups of keyswitches being connected to the outputs of the resonance circuit means corresponding to the respective notes, and bias voltage means connected to each of said groups of keyswitches and resonance circuit means for applying a bias voltage to the output of said resonance circuit means sufficiently great to cancel the output signal thereof.

10. An arpeggio circuit as claimed in claim 9 in which said bias voltage means comprises a changeover switch for connecting said source of bias voltage to said resonance circuit means, said changeover switch having a further terminal which is grounded and which can be connected to said resonance circuit means by actuating the changeover switch.

* * * * *